United States Patent [19]

Charbonnier

[11] 4,252,173

[45] Feb. 24, 1981

[54] LOW-PRESSURE MOULDING PROCESS AND APPARATUS

[75] Inventor: Jean A. Charbonnier, Herblay, France

[73] Assignee: Societe de Vente de l'Aluminium Pechiney, Paris, France

[21] Appl. No.: 884,692

[22] Filed: Mar. 8, 1978

Related U.S. Application Data

[63] Continuation of Ser. No. 765,413, Feb. 3, 1977, abandoned.

[30] Foreign Application Priority Data

Feb. 3, 1976 [FR] France ..... 76 03540

[51] Int. Cl.[3] ..... B22D 17/06; B22D 18/04

[52] U.S. Cl. ..... 164/4; 164/119; 164/155

[58] Field of Search ..... 164/4, 119, 154, 155

[56] References Cited

U.S. PATENT DOCUMENTS

| | | | |
|---|---|---|---|
| 3,761,218 | 9/1973 | Portalier | 164/119 X |
| 3,980,125 | 9/1976 | Portalier | 164/154 |

*Primary Examiner*—Robert D. Baldwin

*Attorney, Agent, or Firm*—McDougall, Hersh & Scott

[57] ABSTRACT

The invention relates to a process and an apparatus for improving the operation for low pressure casting of components such as aluminum and magnesium alloys by controlling the pressure of the inert gas used to cause the metal to flow downwards into the injection tube after the casting of a component at a value higher than that prevailing in the interior of the furnace, the difference between the two pressures being adjustable to a constant value, and enabling two different rates of flow of the inert gas to be established.

9 Claims, 2 Drawing Figures

LOW-PRESSURE MOULDING PROCESS AND APPARATUS

Figure 1:
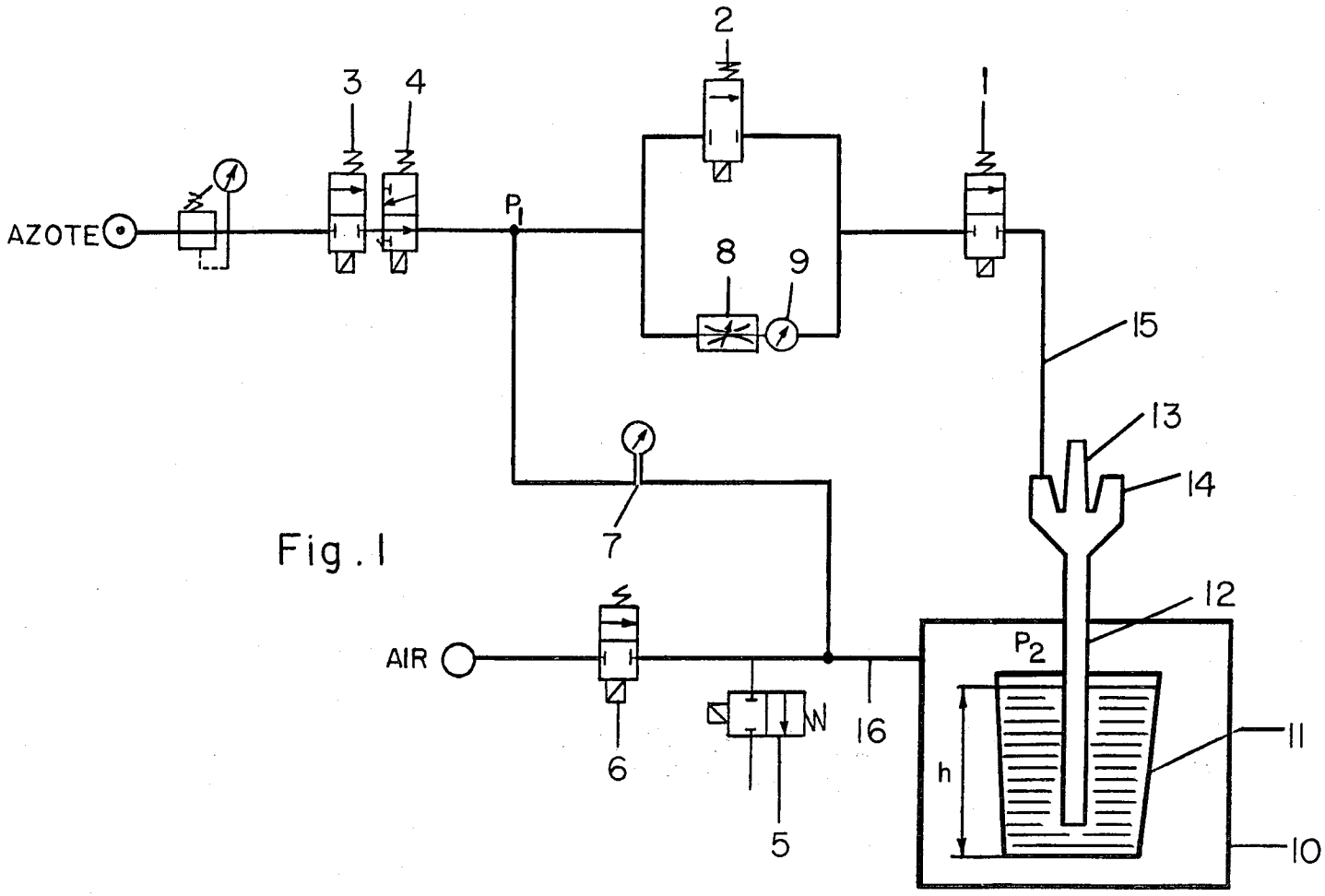

This is a continuation of application Ser. No. 765,413, filed Feb. 3, 1977 (now abandoned).

U.S. Pat. No. 3,980,125 issued on Sept. 14, 1976 describes a low-pressure moulding process illustrated in FIG. 2, comprising between the mould 20 and the tube 12 a so called compression-expansion chamber with two compartments communicating with the tube through a common nozzle. The first compartment 13 connects the tube and the mould, whilst the second compartment 14 communicates with a source N of inert gas under controllable pressure. When the mould has been filled with metal and when the molding has hardened, the injection of inert gas passing from the second compartment of the chamber into the first, just before the interior of the furnace 10 is returned to atmospheric pressure, enables the moulding to be separated from the liquid metal 21 in the first compartment and creates an inert atmosphere in the feed system.

This process is applicable in particular to alloys of alluminium and magnesium.

The inert gas used is preferably nitrogen, although it is also possible to use argon and, generally, any gas which does not react with aluminium or magnesium. Gentle purging with this inert gas is also useful during the operations of extraction of the moulding (mould open) and closure of the mould in order to prevent air from penetrating into the injection tube and the compression-expansion chamber.

Finally, it can be of advantage to inject inert gas into the bath through the injection tube so as to degas the metal between two successive castings for example. Automatic means for feeding and metering inert gas and compressed air are provided in the corresponding pipe systems.

Finally, a control system operating between inert gas and compressed air enables the corresponding pressures to be equalised.

Applicants have discovered a system for controlling the pressure of inert gas feeding the compression chamber at a constant value higher than that prevailing in the interior of the furnace, the difference between the two pressures being constant, but variable and no longer zero, as was the case with the system according to the Parent Patent.

In addition, this system also enables two very different rates of flow to be established in the compression chamber:

(a) a considerable and variable rate of flow on completion of the moulding operation for promoting the rapid flow of the metal which has remained liquid in the chamber, the injection tube and, if necessary, the mould and, optionally, for bubbling the inert gas through the metal;

(b) a low, variable rate of flow during the operations of extraction of the moulding and closure of the mould to ensure that air is usable to penetrate either into the chamber or into the injection tube.

Figure 2:
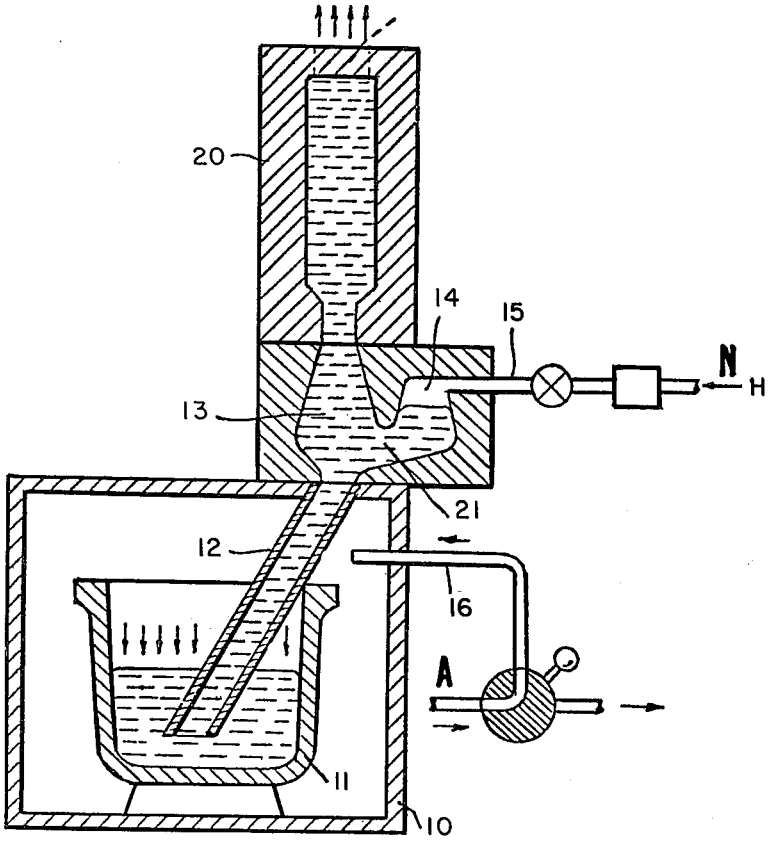

The present invention also relates to the moulding process using this system illustrated in the accompanying drawing in which:

FIG. 1 is a schematic view of the elements employed in the practice of the invention and FIG. 2 is a sectional elevational view in detail of the mold apparatus.

In this drawing, the low-pressure moulding machine is illustrated very diagrammatically by the enclosure 10 containing the crucible 11 filled with liquid metal, the injection tube 12, the compartment 13 of the chamber communicating with the mould (not shown), the second chamber 14 communicating with the source of inert gas through the gas inlet tube 15. The enclosure of the machine communicates with a compressed air source 16.

The system according to the invention comprises two separate circuits:

(a) a compressed air feed circuit equipped with two electrovalves: the electrovalve 6 connects the interior of the furnace with a source of compressed air at a pressure high enough for all the details of the mould to be correctly fed, whilst the electrovalve 5 connects the interior of the furnace with the atmosphere;

(b) an inert gas feed circuit using nitrogen, for example, as the inert gas.

Starting from the source of inert gas under average pressure (a few bars for example), this circuit comprises a two-way electrovalve 3 and a three-way electrovalve 4, the third way communicating with the atmosphere. The circuit then divides into two branches: one of the branches (high rate of flow) comprises a two-way electrovalve 2, whilst the other branch comprises a flow governor 8 which, by variable throttling, provides for a low rate of flow measured by the flow meter 9. Downstream of the junction of the two branches, there is an electrovalve 1 and the circuit arrives at the second compartment of the compression chamber through 15.

A differential regulating manometer 7 permanently compares the inert gas pressure upstream of the two branches $P_1$ with the pressure prevailing in the enclosure $P_2$ and regulates this difference between two positive regulation values a and b:

$$a<P_1-P_2<b$$

by acting on the electrovalves 3 and 4.

This manometer may be formed simply by a mercury-filled U-tube equipped with three electrodes, one connected to the mercury and the other two arranged in the arms at different levels, or by any other system arranged in such a way that it delivers a signal:

for opening the valve 3 when $P_1-P_2$ becomes $<a$ for closing the valve 3 when $P_1-P_2>a$ for connecting the pipe system with the atmosphere when $P_1-P_2>b$ through the three-way electrovalve 4.

In this way, the pressure $P_1$ is regulated between $P_2+a$ and $P_2+b$.

The operation of a casting cycle may thus be described by the following Table:

| | Position* of electro-valve Reference | | | | |
|---|---|---|---|---|---|
| Phase | 1 | 2 | 3 | 6 | Remarks |
| Initial (mould closed ready for casting) | O | C | O | C | A gentle stream of inert gas purges the chambers and the mould. The interior of the furnace communicates with the atmosphere. |
| Phase 1 Injection | C | O | C | O | The flow of inert gas is stopped. The interior of the furnace is placed under pressure. The mould fills. |
| Phase 2 | | | | | The compressed air pressure |

-continued

| Phase | Position* of electro-valve Reference 1 | 2 | 3 | 6 | Remarks |
|---|---|---|---|---|---|
| Hardening | C | O | C | C | is maintained in the interior of the furnace. The moulding hardens. |
| Phase 3 | | | | | |
| Emptying | O | O | C | C | The compressed air pressure is maintained in the interior of the furnace. A vigorous stream of nitrogen is introduced into the chamber. |
| Phase A | | | | | |
| Venting | O | C | O | C | The interior of the furnace is restored to atmospheric pressure With a variable delay in the opening of the valve 5, closure of the valve 2 creates a gentle stream of nitrogen through the chamber. |
| Phase 5 | | | | | |
| Opening of the mould Extraction of the moulding | O | C | O | C | The mould is open. A weak stream of nitrogen continues to flow through the compression chamber. |

*O = open
C = closed

In addition, it should be pointed out that, if the minimal difference a between $P_1$ and $P_2$ is regulated to a value $a > hpg$, where h is the level of the metal in the crucible, p is the voluminal mass of the liquid metal and g is the acceleration of gravity, it is possible to obtain a variant in which the positions of the electrovalves in the initial phase are respectively:

| 1 | 2 | 5 | 6 |
|---|---|---|---|
| 0 | 0 | 0 | C |

In this case, a high rate of flow is obtained for the gas which bubbles through the liquid metal and is removed by the valve 5 and may be used for degassing the metal.

Finally, this system has a last advantage in the low pressure casting of thin-walled components, such as radiator elements, casings, covers etc. In this process, which is the subject of French Patent No. 2,147,827 in the name of Compagnie PECHINEY, the liquid metal is introduced into a cooled mould of which the shape corresponds to the outer shape of the moulding to be produced. The cooling of the mould and the period for which pressure is applied, i.e. the residence time of the liquid metal in the mould, are regulated in such a way that a film-like layer of the required thickness is only hardened.

In the case of large mouldings, emptying of the mould is occasionally accompanied by localised collapses due to a drop in pressure inside the moulding of which the wall, which is still hot, has remained relatively plastic.

The system according to the invention enables this phenomenon to be overcome by increasing the internal pressure in the moulding in such a way that it is higher than the pressure prevailing in the interior of the furnace. To this end, it is sufficient to regulate the limiting values a and b of the difference between the inert gas pressure and the pressure in the interior of the furnace.

I claim:

1. In a low pressure molding apparatus of the type comprising a mold, a compression-expansion chamber communicating with the lower end of the mold, a fluid-tight chamber, a crucible for liquid metal in said chamber, an injection tube communicating the compression-expansion chamber with the crucible, the compression-expansion chamber comprising first and second communicating compartments, a passage communicating the second compartment with a source of gas under pressure, said gas being a gas which is inert with respect to the material to be molded, and a passage communicating the fluid-tight chamber with a source of compressed air, the improvement comprising means for controlling the pressure $P_1$ and the flow of inert gas, means for metering the flow of inert gas, means for controlling the pressure $P_2$ of the compressed air, means for comparing the inert gas pressure $P_1$ and the air pressure $P_2$ prevailing in the fluid-tight chamber and for regulating the difference $P_1-P_2$ between two regulating values a and b.

2. A molding apparatus as claimed in claim 1 in which the means for controlling the inert gas pressure $P_1$ comprises in series in the passage communicating the second chamber with the source of inert gas, a two-way valve, a three-way valve whose third-way communicates with the atmosphere and an operative connection between said valves and the regulator, and an operative connection between said valves and the means for regulating the pressure difference $P_1-P_2$.

3. A molding apparatus as claimed in claim 1 in which the means for comparing the inert gas pressure $P_1$ and the air pressure $P_2$ comprises a differential regulating manometer placed on an operative connection, one end of which communicates with the passage of inert gas downstream the three way valve and the other end communicates with the passage of compressed air downstream the two valves.

4. A molding apparatus as claimed in claim 1 in which the means for controlling means for the flow of inert gas comprise parallel passages interposed in the passage communicating the supply of inert gas with the second compartment and a two-way valve in one of the parallel passages for providing a high rate of flow through and a flow governor in the other of the parallel passages for throttling the rate of flow-through.

5. A molding apparatus as claimed in claim 1 in which the means for controlling the pressure $P_2$ of the compressed air comprises two valves the first connecting the interior of the enclosure with a source of compressed air and the second connecting the interior of the enclosure with the atmosphere.

6. A low pressure molding process comprising positioning a mold in communication with the upper end of a compression-expansion chamber having first and second communicating compartments and an injection tube which extends downwardly into a crucible housed within an enclosure, introducing gas under pressure into the enclosure to force liquid metal from the crucible up through the injection tube and the compression-expansion chamber into the mold, releasing said excess pressure in the enclosure after at least partial solidification of the metal in the mold to enable non-solidified metal to flow back into the crucible, feeding the second compartment of the compression-expansion chamber with an inert gas under pressure, monitoring the pressure $P_1$ of inert gas fed to the second compartment and the pressure $P_2$ in the enclosure, and regulating the difference between $P_1$ and $P_2$ in such a manner that $a < P_1-P_2 < b$.

7. In a low pressure molding apparatus having a furnace, a crucible within the furnace for housing molten metal to be cast, a source of compressed air, a source of inert gas, a compression-expansion chamber having two compartments with a common nozzle, an injection tube communicating the crucible with the nozzle of the compression-expansion chamber, one compartment having a passage for communicating with the mold into which the metal is to be cast, means communicating the other compartment with the source of inert gas, and means communicating the furnace with the source of air under pressure, the improvement comprising valve means for controlling pressure $P_1$ and flow of inert gas from the source of inert gas to the other compartment, other valve means for controlling the pressure $P_2$ and flow of air from the source of air under pressure to the furance, and means for comparing the pressure $P_1$ of inert gas and the pressure $P_2$ of air in the furnace and for regulating the differential between the pressure $P_1$ and $P_2$.

8. An apparatus as claimed in claim 7 in which the valve means for comparing the pressure $P_1$ and $P_2$ operates to control the pressure $P_1$ and $P_2$ to provide for a minimal difference which equals hpg wherein h is the level of the metal in the crucible, p is the massive liquid metal and g is the specific gravity of the metal.

9. A low pressure molding process which includes the steps of purging a mold in communication with the upper end of one compartment of a compression-expansion chamber, the lower end of said compartment being in communication through an injection tube with a furnace containing crucible, purging the compression-expansion chamber with a gentle stream of inert gas while communicating the furnace with the atmosphere, stopping the flow of inert gas to the compression-expansion chamber while communicating the furnace with a source of air under pressure to place the furnace under pressure and force liquid metal from the crucible through the injection tube and the one compartment to fill the mold, maintaining the air pressure within the furnace until the metal cast into the mold has hardened, maintaining the air under pressure in the furnace while introducing a vigorous stream of inert gas into the compression-expansion chamber, relieving the furnace of air under pressure while reintroducing a gentle stream of inert gas into the compression-expansion chamber after a slight delay, removing the mold while continuing to flow a slow stream of inert gas through the compression-expansion chamber.

* * * * *

UNITED STATES PATENT OFFICE

CERTIFICATE OF CORRECTION

Patent No. 4,252,173 Dated February 24, 1981

Inventor(s) Jean A. Charbonnier

It is certified that error appears in the above-identified patent and that said Letters Patent are hereby corrected as shown below:

Col. 1, line 60 delete "usable" and substitute -- unable --

Signed and Sealed this

*Twenty-sixth* Day of *May 1981*

[SEAL]

*Attest:*

RENE D. TEGTMEYER

*Attesting Officer* *Acting Commissioner of Patents and Trademarks*